US008474822B2

(12) United States Patent
Chen et al.

(10) Patent No.: US 8,474,822 B2
(45) Date of Patent: Jul. 2, 2013

(54) CRAPS BLACKJACK

(75) Inventors: Hui Chuan Chen, Norwich, CT (US); Martin Chi Wong, Norwich, CT (US)

(73) Assignee: Hui Chuan Chen, Norwich, CT (US)

( * ) Notice: Subject to any disclaimer, the term of this patent is extended or adjusted under 35 U.S.C. 154(b) by 0 days.

(21) Appl. No.: 13/373,655

(22) Filed: Nov. 22, 2011

(65) Prior Publication Data

US 2012/0135791 A1 May 31, 2012

Related U.S. Application Data

(63) Continuation-in-part of application No. 12/800,023, filed on May 6, 2010, now abandoned.

(51) Int. Cl.
*A63F 1/00* (2006.01)
*A63F 13/00* (2006.01)

(52) U.S. Cl.
USPC ..... 273/292; 273/274; 463/12; 463/13

(58) Field of Classification Search
USPC ..... 273/292, 274, 309; 463/12, 13
See application file for complete search history.

(56) References Cited

U.S. PATENT DOCUMENTS

| | | | | |
|---|---|---|---|---|
| 6,095,525 | A * | 8/2000 | Terminel | 273/274 |
| 6,749,199 | B2 * | 6/2004 | Boyd | 273/292 |
| 2004/0080110 | A1 * | 4/2004 | Webb | 273/292 |
| 2005/0212213 | A1 * | 9/2005 | Inglese | 273/292 |

* cited by examiner

*Primary Examiner* — Benjamin Layno

(57) ABSTRACT

A modified blackjack card game using an electronic gaming machine and 6 or 8 decks of standard playing cards without jokers, Craps Blackjack is playing in electronic device, computer, slot machine, video game, etc. and using two steps wagering strategies, win or lose at two initial cards and continue to play or fold the hand and providing six side bets. It is a card game combined the playing method of craps, poker and blackjack. It provides optional side bets, dragon's head and phoenix's tail, ace-deuce, ace-ace, any eleven, any seven, and six-six and two main bets, Craps Blackjack and Any Craps.

15 Claims, 12 Drawing Sheets

CRAPS BLACKJACK

CROSS-REFERENCE TO RELATED APPLICATION

This application is based on and claims the benefit of U.S. Ser. No. 12/800,023 filed on May 6, 2010 now abandoned, entitled "Craps Blackjack".

BACKGROUND OF THE INVENTION

1. Field of the Invention

This invention relates generally to card games, blackjack, poker and craps, a dice game. It combines the playing method of blackjack card game and poker card game and the proposition betting bonus as the craps game offered to players.

The U.S. Pat. No. 5,695,192, Craps Qualified by Blackjack of Brown, Breck teaches how to play a combination card game with dice;

The U.S. Pat. No. 8,020,872, Blackjack and Poker game Combination of Forster, Michael Williams teaches how to use the same cards dealt to player to play Blackjack card game and poker card game;

The U.S. Pat. No. 6,877,746, Jerry Herren teaches how to play "the option of exchange one or more of the player's dealt cards" an electronic blackjack card game with additional fee, 50% of the player's original wager. Wikipedia, the free encyclopedia states that " . . . The player is dealt an initial two card hand with the option of drawing cards to bring the total value to 21 or less without exceeding it, so that the dealer will lose by having a lesser hand than the player or by exceeding 21. Many rule variations of blackjack exist." " . . . Player's decision . . . Hit . . . , Stand . . . , Double down . . . , Split . . . , Surrender . . . , and Insurance . . . ."

US patent application 20060214373, Michael Allen uses a special designed craps cards, contain only six numbers, from 1 to 6, corresponding to the 6 different faces of a die, instead of using two dice to play the craps game; there are 8 sets of 6 cards numbered from 1 to 6, total 48 cards in a deck, to play traditional craps game way back to late 1800's. Dealer flaps the cards to find the combination number representing the roll of two dice.

2. Description of Related Arts

Craps, a two dice game, provided two opposite betting strategy, pass line and don't pass line as main betting area with variety odds on all different numbers offering to players through propositional bet, hard ways, and place bet. The game is betting on the outcomes of combination of two dice after a rolling. Pass line wager will win on 7 and 11 and lose on 2, 3, and 12 on the come out roll. Don't pass line wager will win on 2 and 3, push on 12 and lose on 7 and 11 on the come out roll. Players can also betting the combination result from a rolling of two dice, such as, 2, 3, 4, 5, 6, 7, 8, 9, 10, 11, and 12 without placing wager on pass line or don't pass line. For a better odds return to players, the game provide a proposition betting area that contains the combination of two dice, such as, 2, 3, 7, 11, and 12. These bets are one time single bet.

The conventional craps game provides players multi-wagering areas to win the game; such as pass line and don't pass line and other wagering areas with all the combinations of two dice. The 'pass line' bet can be lost in either of two ways: Either the shooter rolls a craps number (2, 3, or 12) on the come-out roll, or he establishes a point and subsequently 'sevens-out'. The 'don't pass' line bet can be win in either of two ways: Either the shooter rolls a craps number (2, 3, or 12) on the come-out roll, or he establishes a point and subsequently 'sevens-out'. The 'pass line' bet can be won in either of two ways: Either the shooter rolls a total number of 7 or 11 on the come-out roll, or he establishes a point and subsequently 'repeat the point'. The 'don't pass' line bet can be lose in either of two ways: Either the shooter rolls a total number of 7 or 11 on the come-out roll, or he establishes a point and subsequently 'repeat the point'.

The conventional blackjack card game provides players one way of playing; betting on the out-come of two initial cards has a blackjack hand or draw additional cards until player satisfied the out-come of multi-cards. Players win or lose the bet is based on the predetermine rules. The game of "blackjack" or "twenty-one" is typically played with a standard deck of playing cards containing fifty-two cards in four different suits with numerical value equal to their face value from one pip to ten pips and three face cards (i.e., king, queen and jack) are assigned a numerical value of ten points each. An ace card may be assigned either a point value of one or eleven.

The object of the blackjack card game is for each player to collect a number of cards in his or her hand whereby the total point value assigned to the cards in a player's hand is as close to possible to twenty-one without going over. If the point value in a player's hand exceeds twenty-one points, the player "busts" and is eliminated from further play.

Each player should place a wager initially to receive two cards to start the game. In traditional blackjack, each player is playing against the dealer or "house". The dealer or house acts as the bank, paying all losses and collecting all winnings from the other players at the table. In order to win his or her wager, the cards in a player's hand must have a higher total point value than the total point value in the dealer's hand without going over twenty-one points. During a player's turn, a player may elect to draw additional card which is called "take a hit", or play only the cards currently held in his or her hand which is called "stand". A player may continue to receive additional cards in order to try to reach a point total of twenty-one without exceeding twenty-one.

Blackjack is a card game comprises one or more players individually playing against the "house". Most of casinos set the procedure as, dealer is dealt one face down card and one face up card and players are dealt two face-up cards.

With conventional blackjack, all players must place a minimum bet and attempt to receive a card combination that is equal to or slightly below "21".

The object of conventional blackjack is to either, (1) receive "21", (2) receive a hand greater in value than the house, or (3) remain under "21" with the house "bursting" or going over "21". Blackjack card game players are involved in a contract bet as a blind bet in poker game.

Playing method of conventional poker game allows players place small amount of wager to start playing the game; and offers player different playing strategy, such as fold, check, call, etc. Players have the chance to see few cards before they place big amount of wager to finish the game.

This new invention is related to conventional Blackjack card game, Poker card game and Craps dice game. It is used multi-decks of standard 52 playing cards in deck to play a Craps style blackjack card game. Instead playing a single blackjack card game, dealing two initial cards to players and dealer; giving playing a chance to see the first two initial card, and win or lose the wager on both side bet and primary bet; then take additional cards to improve the value of the hand up to 21, or fold the hand as one of the strategy of conventional poker card game. The new invention provides two main wagering areas and six side wagering areas for players to choose. Players have more chance to win the bonus as winning the bonus on craps dice game through betting the first initial two cards has a total value of 2, 3, 7, 11, and 12 and a player-dealer combination of open ends straight named Dragon's head and Phoenix' tail.

BRIEF SUMMARY OF THE INVENTION

The present invention, Craps Blackjack, is a modified blackjack card game playing in a live casino game table and electronic device, such as computer, slot machine, video game, etc. and using two steps wagering strategies, win or lose at two initial cards and continue to play or fold the hand. It provides six side bets, dragon's head and phoenix's tail, similar to the hand of straight in poker card game, ace-ace, ace-deuce, six-six, any 7 and any 11, two main bets are similar to the proposition wagering area of craps game.

The invention also combines a playing method similar to poker card game and craps dice game. Player place an initial wager to receive two initial cards, after winning or losing the initial wager, player can continue to play the same card with additional wager or withdraw the game, fold the hand. There are two main wagering spots, Any Craps and Craps Blackjack, for players betting on the outcome of two initial cards contains ace-ace, ace-deuce, any 7, any 11, and six-six; Any Craps wager loses on 7 and 11; Craps Blackjack wager loses on ace-ace, ace-deuce and any 12. These combinations also offer as side bet that is providing better odds. Beside the five propositional side bet, player can also betting on the outcome of player's two initial cards and dealer's face up card, Dragon's head and phoenix' tail (open ends straight).

Players have the option to wager on Any Craps and Craps Blackjack only or both Any Craps and Craps Blackjack (same as the playing blind in poker game) on one hand in order to play the game. The wager on Any Craps will win when the two initial cards has a total pip value 2, and 3, and push on 12 and will lose when the total pip value of two initial cards is 7 and 11. The wager on Craps Blackjack will win when the two initial cards has a total pip value 7 and 11, and will lose when the total pip value of two initial cards is 2, 3, and 12.

The side bet, dragon's head and phoenix's tail, is a three card straight hand that contains player's two initial cards and dealer's face-up card, said, player's two initial cards are king and queen and dealer's face-up card is jack, the wager on side bet then will get pay according to odds casino offer.

All the wagers have to be place before the two initial cards are dealt to player and dealer. After the two initial cards are dealt to the player and dealer, dealer has to resolve the wager on side bet and the two main bets.

After the wagers on side bet, Any Craps bet and Craps Blackjack bet is resolved, players have the second chance to place wager on the Craps Blackjack to continue play the hand as the playing method of poker card game and craps dice game. Said, player places the wager on Any Craps only before the two initial cards are dealt and lost the wager to 7 or 11, the player will be allowing to place additional same amount of wager to the original wager to continue play the hand with the original two initial cards. Players also have the option not to continue playing the game after they seen the two initial cards and win or lose their wager on the Any Craps.

When the player who wagers on Any Craps as initial bet only got a blackjack hand, the wager will get pay for blackjack and not allow to continue play the game, the player can't wager on the Craps Blackjack after the blackjack happened.

Players who wager on both Any Craps and Craps Blackjack before the two initial cards are dealt got a blackjack hand will be pay for both wagers, 3 to 2 for the wager on both Any Craps and Craps Blackjack as the conventional blackjack card game; the wager on the side bet will be pay according to the payout chart of side bet bonus casino offer.

Craps Blackjack card game is a modified blackjack card game that gives players a chance using the playing strategy of poker card game. It also provides better odds as craps dice game through the side bet bonus to the player. The unique playing method of Craps Blackjack is players can wager on the side bet with primary bet, named Any Craps, first to receive two initial cards, then decide to continue playing the game or fold the hand as the playing method of poker card game. When the player wager on Any Craps and Craps Blackjack did not have a total pip value of 2, 3, 7, 11, and 12 on the two initial cards, they can select to play the hand without additional wager, or surrender the hand with losing half of the wager.

Craps Blackjack card game requires players placing an initial wager on the designed wagering area, named Dragon's head and phoenix' tail, ace-ace, ace-deuce, six-six, Any 7 and any 12, Any Craps and/or Craps Blackjack before the cards are dealt to the players and dealer.

The wager placed on Any Craps will lose on the total pip value of 7 and 11 of the two initial cards. After two initial cards are dealt to the player and dealer, player who lost the wager placed on Any Craps can choose to fold the hand or play the hand with additional wager, same amount of wager as the original wager, placed on Craps Blackjack and compare the final result of their hand to dealer's final result of the hand in order to win or to lose their bet.

The wager placed on Craps Blackjack will lose on the total pip value of 2 and 3 and push on 12 of the two initial cards. Player who lost the wager on Craps Blackjack to the total pip value of 2, 3, or 12 of two initial cards can choose to fold the hand or continue playing the game with an additional wager place on the Craps Blackjack and compare the final result of the hand to dealer's final result of the hand in order to win or to lose their bet. Six or eight decks of standard cards can be use in Craps Blackjack card game. Picture cards, jack queen, and king have a respectively point of 10, and 2s, 3s, 4s, 5s, 6s, 7s, 8s, 9s and 10s have a point card value equivalent to their face card value which is respectively point of 2, 3, 4, 5, 6, 7, 8, 9, and 10. Ace has a respectively point of 11 or 1. The combination of an ace and a face card or a ten is called blackjack.

Any Craps bet is a primary bet that is betting on the two initial cards and continue playing the hand; Craps Blackjack bet is the secondary bet, a backup bet of Any Craps bet, for player re-place the wager to continue playing the game with the same initial two cards when the wager on Any Craps lost on the seven and eleven. The first object of Craps Blackjack card game is to win the bonus of side bet and primary bet; the second object of Craps Blackjack card game is to draw a hand having a value (a card sum or card point total) as close to 21 as possible without going over 21. Wagers on the Any Craps will win the bonus from the two initial cards total points of 2, 3, and 12, and lose when the two initial cards has a total point 11 and 7. Wagers on the Craps Blackjack will lose when the two initial cards total point is 2, 3, and 12 and win the even amount of the bet when the two initial cards total is 7 and 11. Wagers on side bet, Dragon's head and phoenix's tail, will win when the two initial cards has a consecutive numbers that connects to dealer's face-up card and will get pay with variety odds casino offer.

The combination of 2 is A-A. The combination of 12 includes 10-2, 9-3, 8-4, 7-5, and 6-6. The combination of 11 includes 9-2, 8-3, 7-4, and 6-5. The combination of 3 is ace-2. The combination of 7 includes ace-6, 3-4 and 5-2.

The electronic device, electronic gaming machine, is refer to computer, slot machine, video game, and internet used to deliver the new invention, craps blackjack card game. The same layout, game rules and dealing procedure will remain the same as the description above when the electronic gaming machine is not available and the game has to be delivering by manually.

Figure 1:
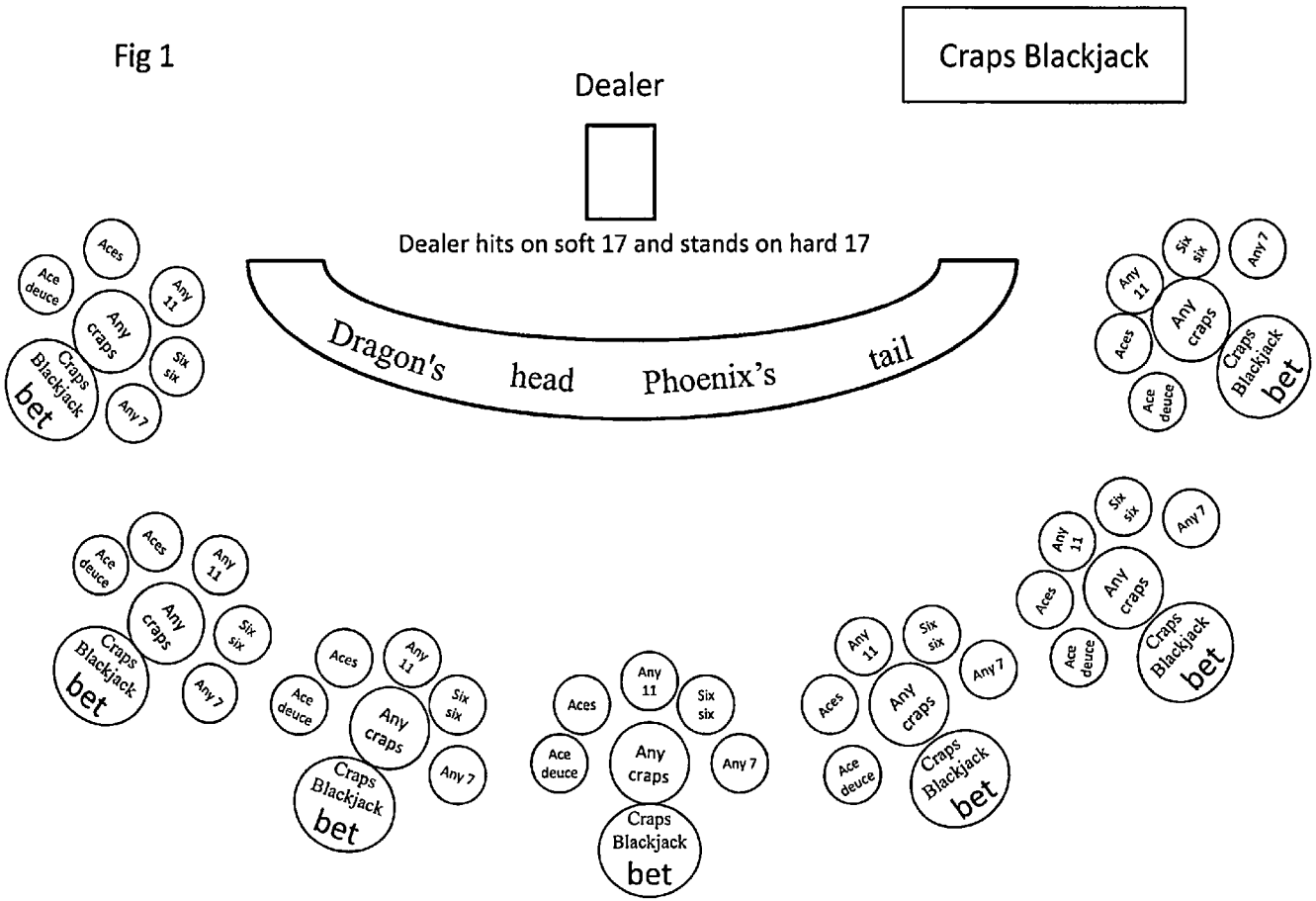
FIG. 1 is the layout of Craps Blackjack card game. There are side bet circles, a primary bet circle named Any Craps, and a secondary bet circle named Craps Blackjack.
Figure 2:
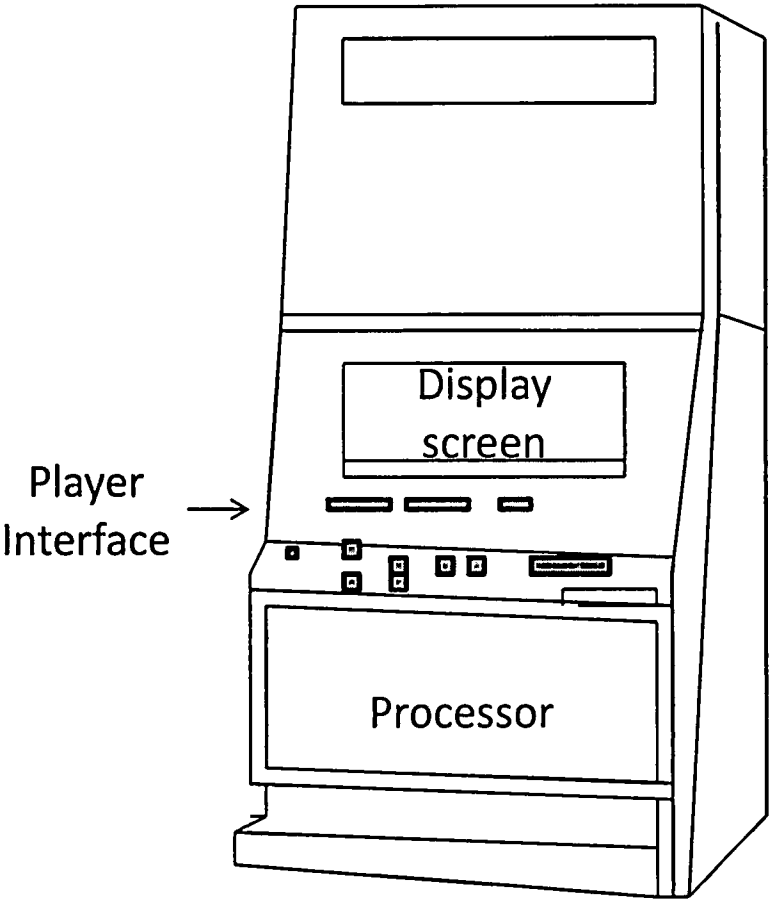
FIG. 2 an example of electronic device
Figure 3:
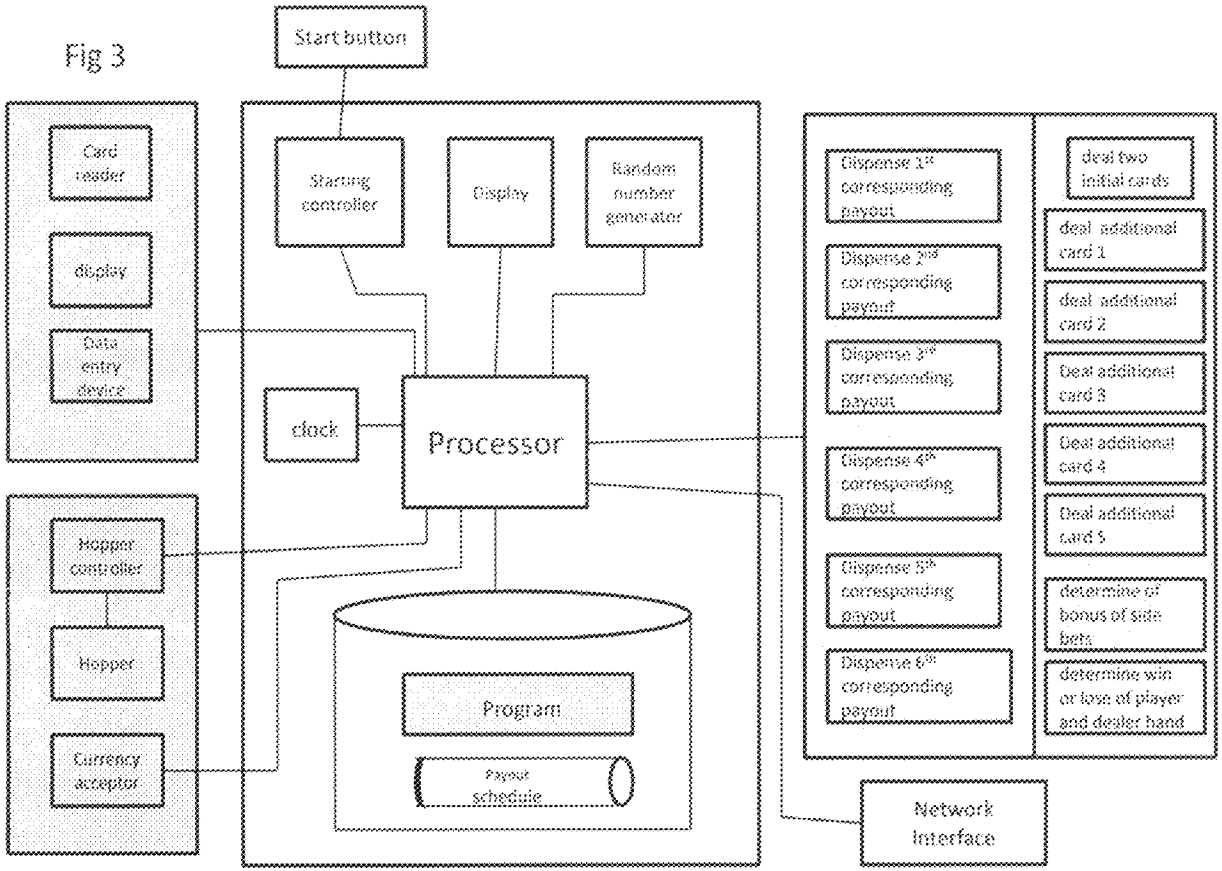
FIG. 3 mother board
Figure 4:
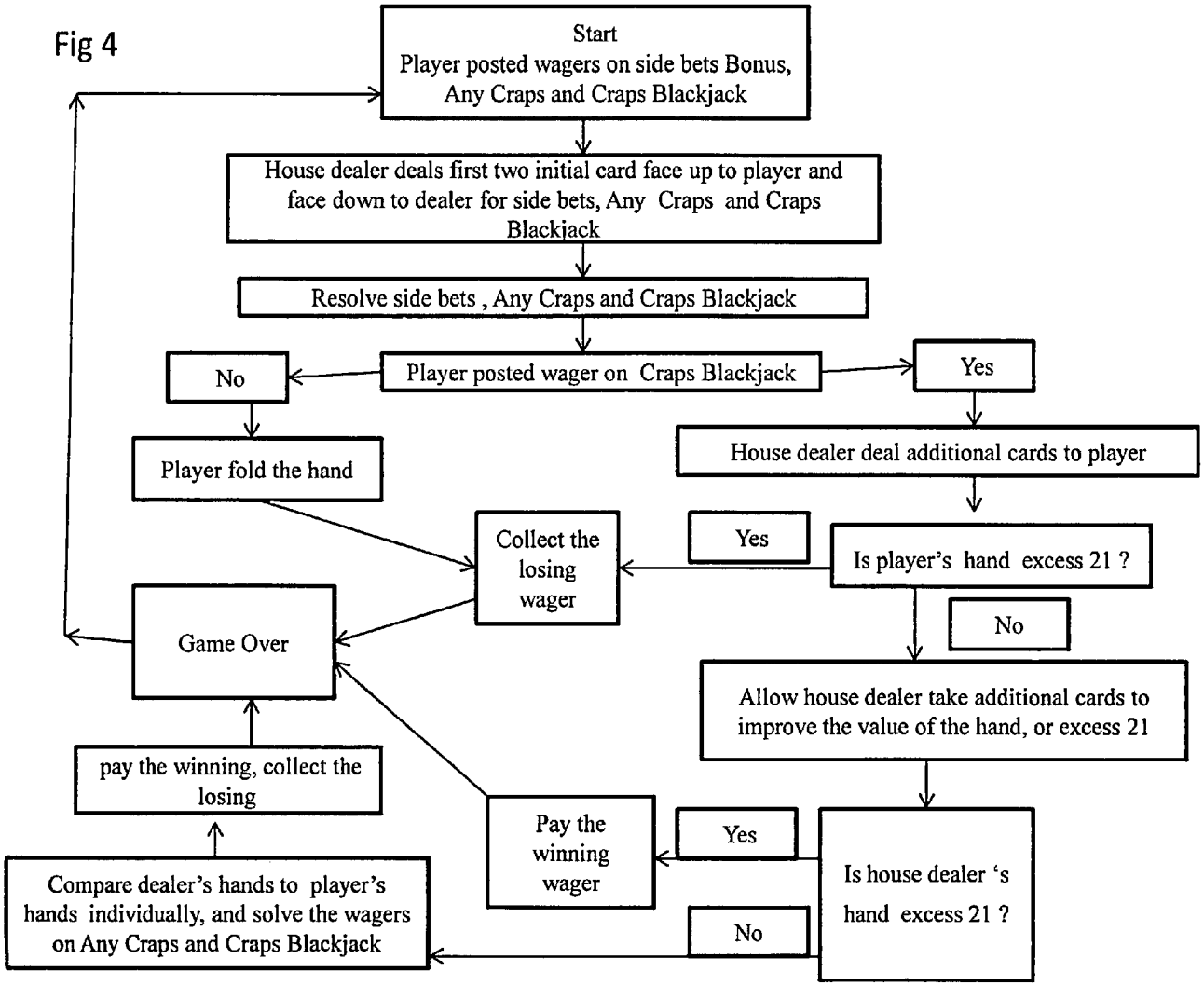
FIG. 4 example of dealing program
Figure 5:
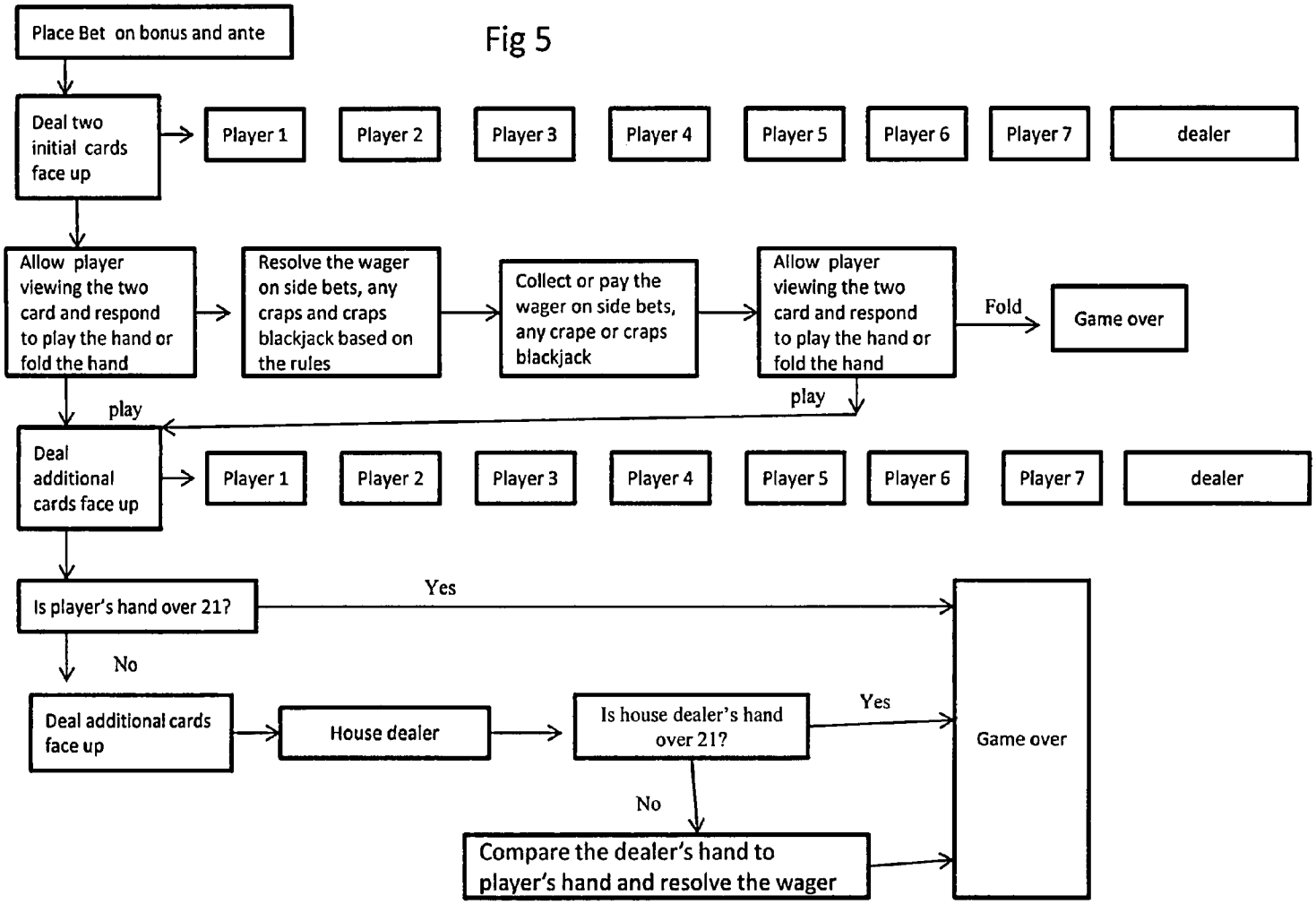
FIG. 5 example of dealing program
Figure 6:
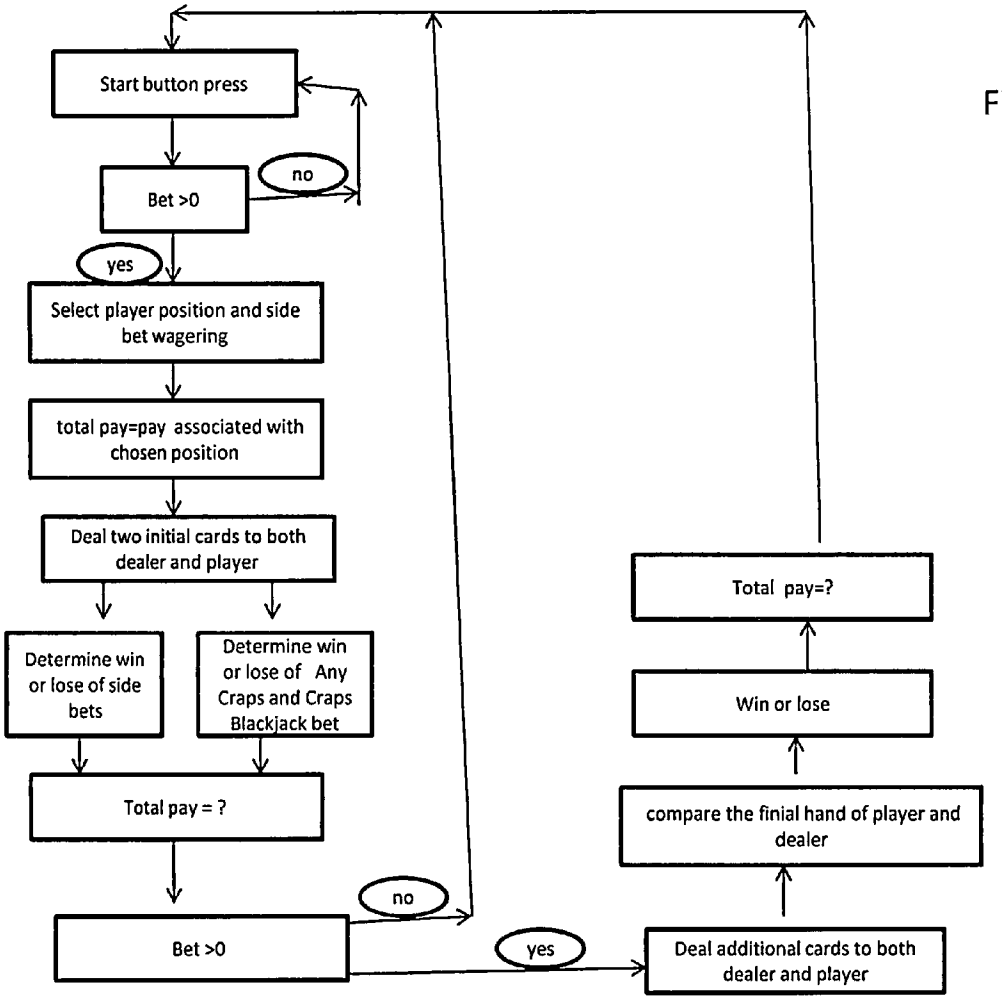
FIG. 6 example of dealing program
Figure 7:
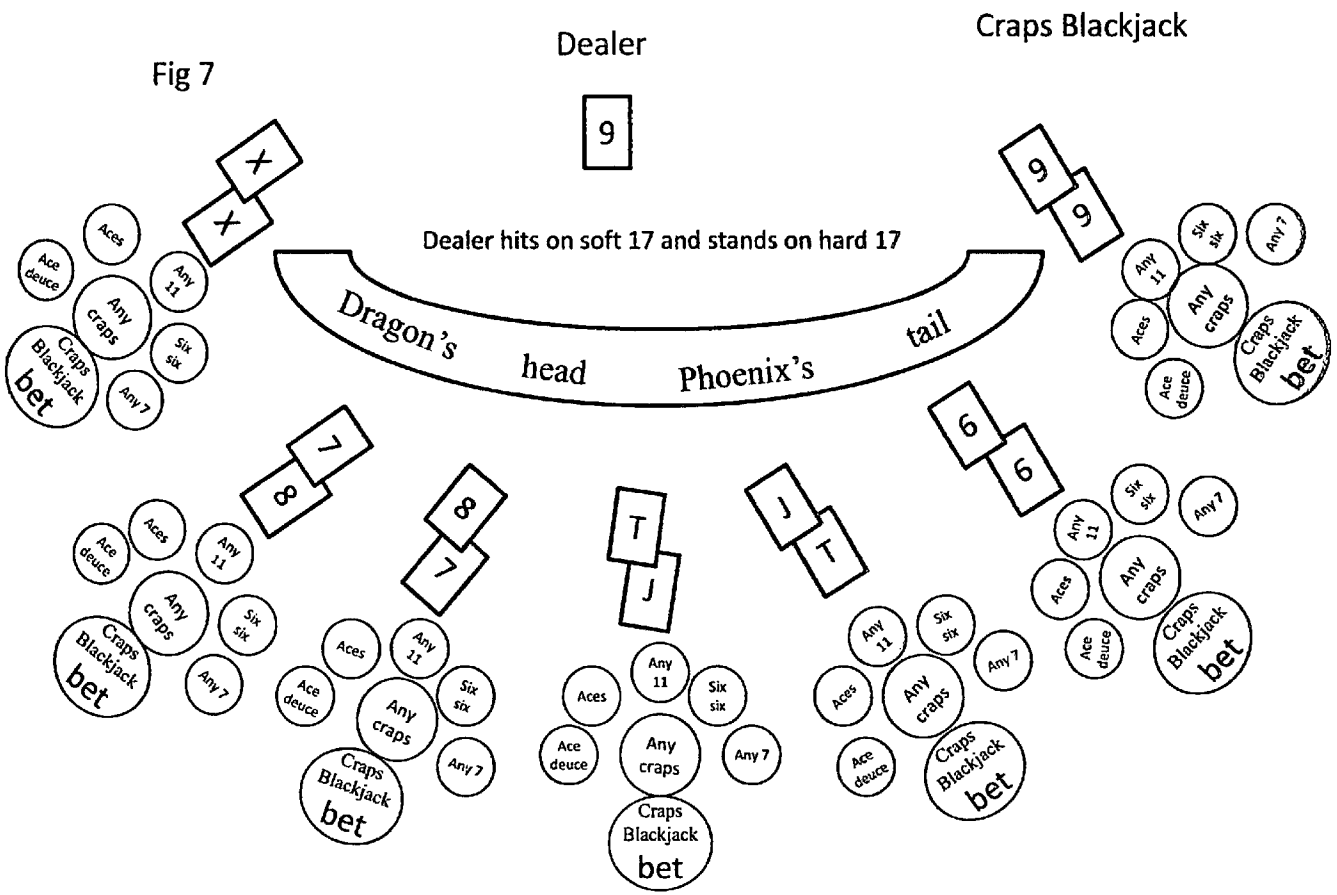
FIG. 7 example of two initial card of bonus hand
Figure 8:
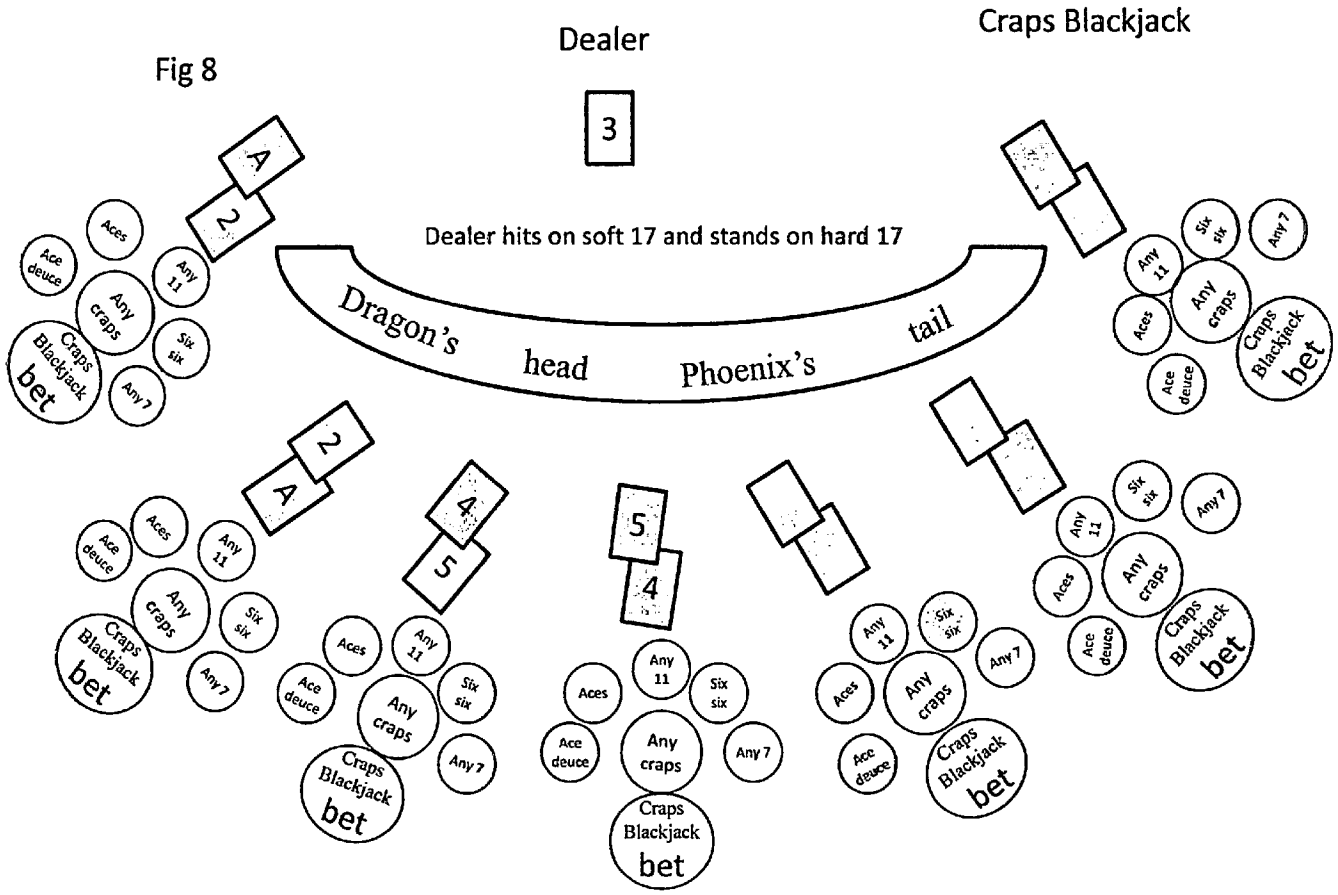
FIG. 8 example of two initial card of bonus hand
Figure 9:
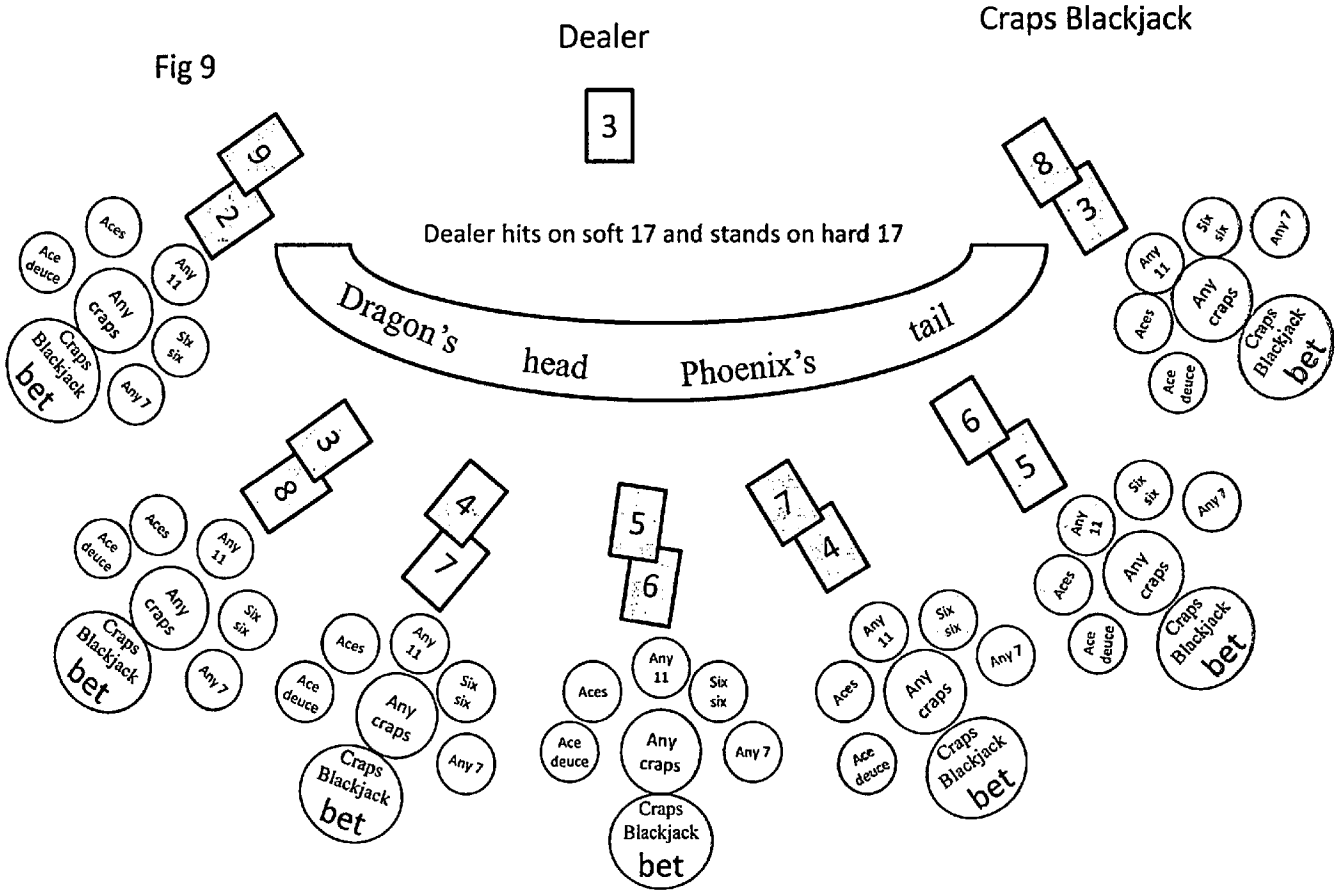
FIG. 9 example of two initial card of bonus hand
Figure 10:
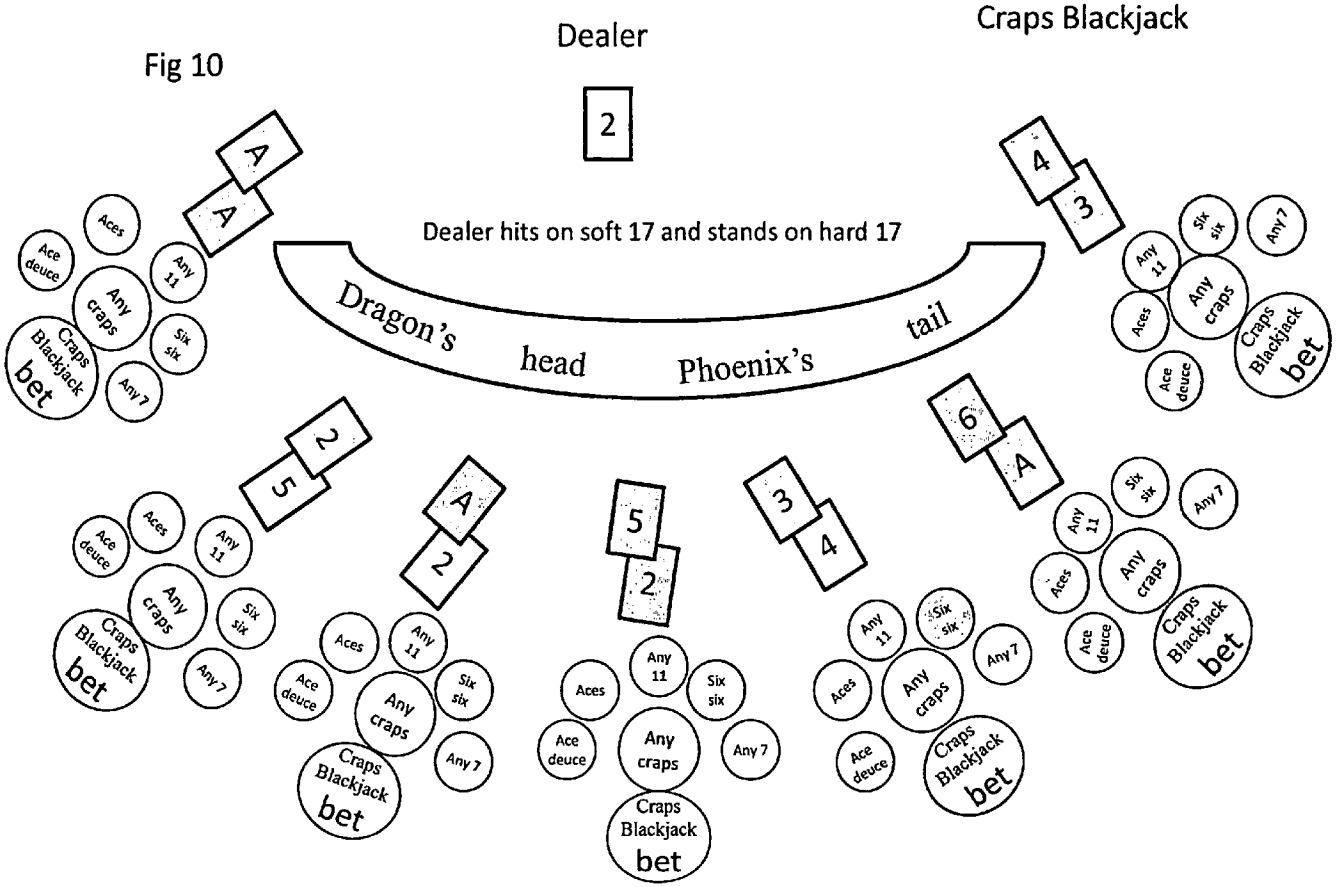
FIG. 10 example of two initial card of bonus hand
Figure 11:
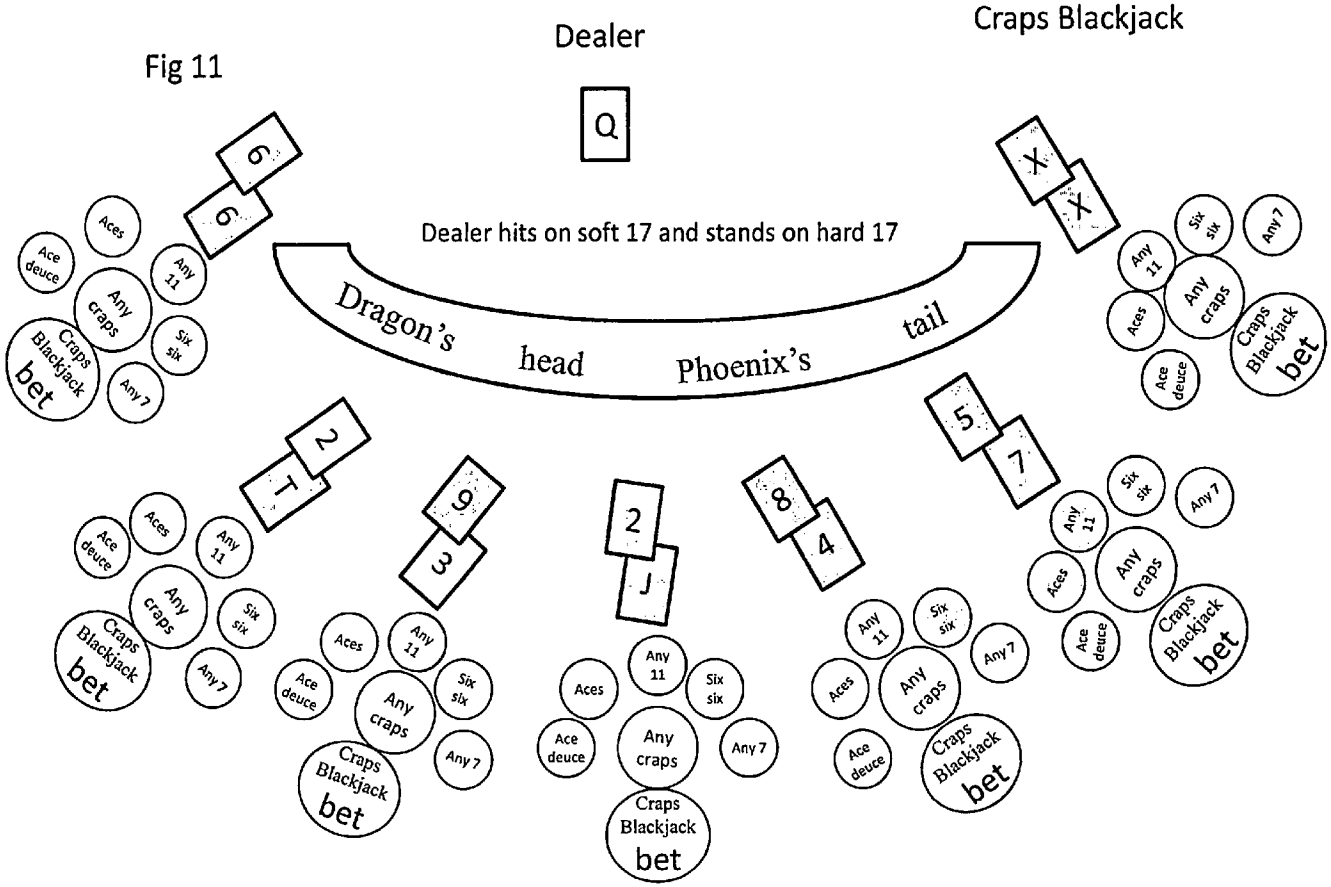
FIG. 11 example of two initial card of bonus hand
Figure 12:
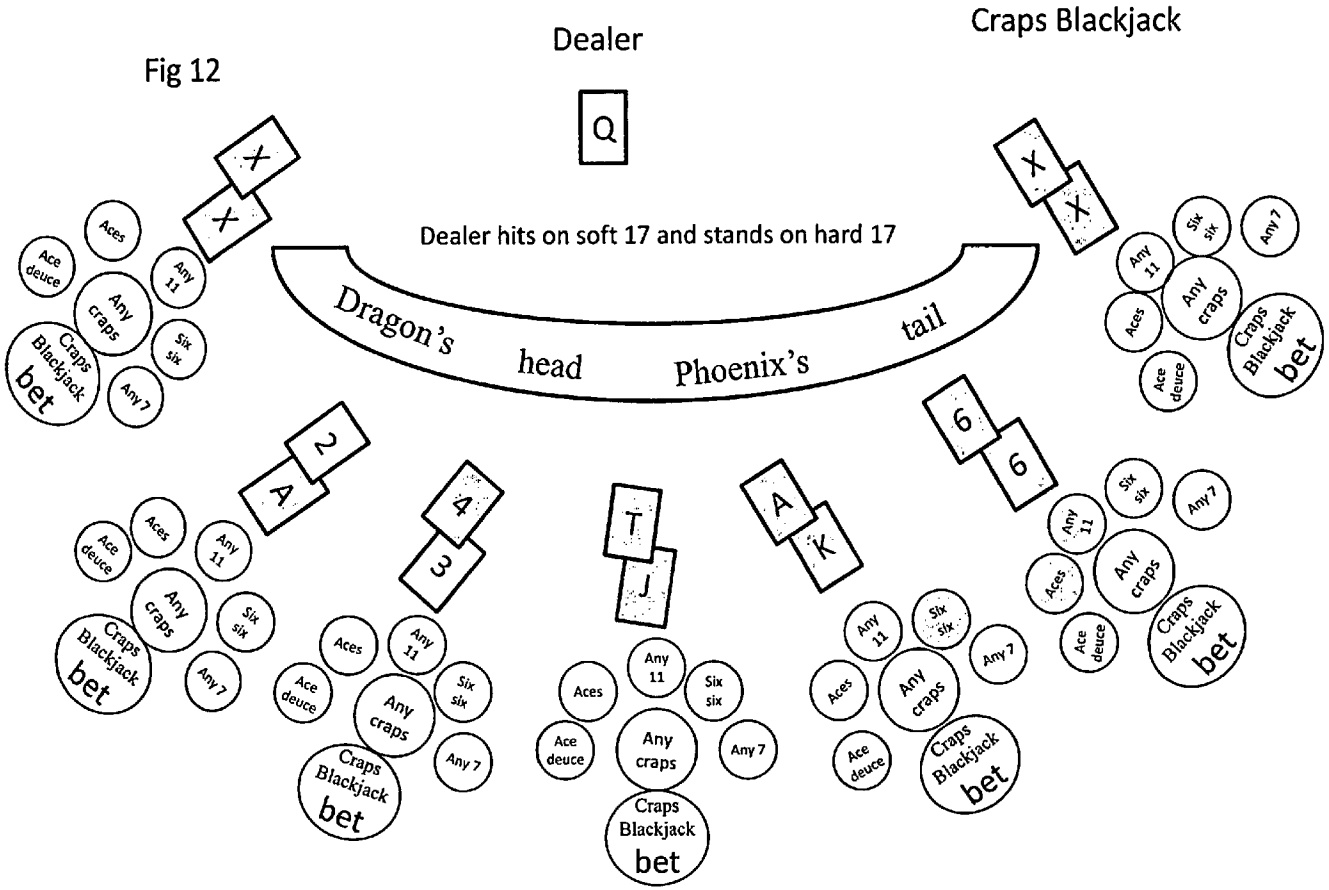
FIG. 12 example of two initial card of bonus hand

What is claimed is:

1. A playing method for a plurality of players and a dealer using an electronic gaming machine, and a computer to generate images of 6 or 8 decks of standard playing cards to play a Craps Blackjack card game, the gaming machine having a non-transitory computer readable medium encoded with instructions and executed by a processor to perform the steps of:

(a) providing a designed layout with Any Craps betting circle as a primary bet, Craps Blackjack betting circle as a secondary bet and optional side bets, dragon's head and phoenix's tail, ace-deuce, ace-ace, any eleven, any seven, and six-six, and with 6 or 8 decks of playing cards image or an electronic representation of cards on an electronic display;

(b) allowing a player to place a wager on dragon's head—phoenix's tail side bet, ace-deuce, ace-ace, any eleven, any seven, and six-six and Any Craps, and Craps Blackjack; display a player with two initial playing cards; display a dealer with two initial playing cards; resolving the wagers on dragon's head—phoenix's tail side bet, optional side bets, ace-deuce, ace-ace, any eleven, any seven, and six-six, and Any Craps and Craps Blackjack bet corresponding to first two initial cards; allowing the player to fold the hand or continue to play a blackjack game using the two initial playing cards; allowing both player and dealer take additional cards; comparing the final total pip number of player's hand to the total pip number of dealer's hand and resolving the wager of player;

(c) allowing players wager on Any Craps bet that is betting on the first two initial cards having a total pip number of 2, 3, or 12 only with or without side bet wager, or wager on Craps Blackjack bet that is betting on the first two initial cards having a total pip number of 7 or 11 only with or without side bet wager or wager on both Any craps and Craps Blackjack with or without side bet wager before the two initial cards are dealt to players and house dealer;

(d) accepting player wagers on side bets, dragon's head and phoenix's tail that is betting on player's two initial cards combined with dealer's face up card to form a straight, ace-deuce that is betting on player's two initial cards contains an ace and a deuce, ace-ace that is betting on player's two initial cards contains two aces, six-six that is betting on player's two initial cards contains two sixes, any 7 that is betting on player's two initial cards total of 7, and any 11 that is betting on player's two initial cards total of with wager on either or both Any Craps bet and Craps blackjack bet;

(e) dealing the player/players and dealer two initial cards; and dealing player/players and dealer additional cards based on the game rules;

(f) providing a game rules 1) wagers on Any Craps bet will lose when the two initial cards dealt to player has a total of 7 or 11; a game rule 2) wagers on Craps Blackjack bet will lose when the two initial cards dealt to player has a total of 2, 3, or 12; a game rule 3) players have a second chance to bet on the two initial cards after player lose the wager on Any Craps with additional wager place on Craps Blackjack and receiving additional cards to complete the game; providing players a second chance to bet on the two initial cards after lose the wager on Craps Blackjack with additional wager place on Craps Blackjack and receiving additional cards to complete the game;

(g) providing a game rule 4) the players the option of fold the hand or continue play the hand after win the wager on Any Craps and Craps Blackjack or lose the bet on Any Craps and Craps Blackjack when the pip number of first two initial cars total is 2, 3, 12, 7, or 11; game rule 5) player can surrender the hand or continue play the hand when the total pip number of first two initial cards are 4, 5, 6, 8, 9, 10, 13, 14, 15, 16, 17, 18, 19 or 20 with rules of conventional blackjack card game;

(h) completing the craps blackjack game pursuant to pre-established rules of the craps blackjack game, said pay or take the wager on side bets, dragon's head and phoenix's tail, ace-deuce, ace-ace, any eleven, any seven, and six-six and Any craps bet or Craps blackjack bet; after the wager lost on Any craps or Craps blackjack, players has to place a secondary wager in order to continue play the game with the original two initial cards, then machine/dealer deals additional cards to the hand with any total pip number as player's request, compare dealer's hand to player's hand individually, and resolve the wager on Any Craps and/or Craps Blackjack;

(i) resolving the player wager pursuant to pre-established payouts of dragon's head—phoenix's tail side bet, ace-deuce, ace-ace, any eleven, any seven, and six-six before additional card deals;

(j) resolving the player wager pursuant to pre-established payouts of Any craps and Craps blackjack after compare the hands of player and dealer hand;

(k) providing a game rule 6) that allowing players to take additional cards, stand on any pip number total is not excess 21, split the pairs, place additional wager said, double on any number of two initial cards, surrender the hand with losing half of the wager on the two initial cards; and placing the secondary wager on Craps Blackjack bet when player lost the wager on Any Craps or Craps Blackjack and still want to play the game; game rule 7) the higher total point a hand can get is 21 and any total point is over 21 considering as bust, also called lost; if the total of the value of the cards in the dealer's hand is 21 or less and is greater than the value of the cards in the player's hand, then the player loses the bet; if the total of the value of the cards in the player's hand is 21 or less and is greater than the total of the value of the cards in the dealer's hand, then the dealer loses the bet; if the player's and dealer's hand are of equal value and 21 or less, then the bet is pushed; game rule 8) a blackjack hand is the two initial cards contains an ace and a ten value card or any face card and it is higher than 21;

(l) requiring dealer resolve the wager on dragon's head—phoenix's tail side bet, ace-deuce, ace-ace, any eleven, any seven, and six-six, Any craps and Craps Blackjack Bet, then continue dealing the game, and resolve the wager on Any craps and Craps Blackjack Bet; dragon's head—phoenix's tail side bet is a three card straight, dealer's face-up card combines player's two initial card, dealer's face-up has to be the beginning of straight or the end of the straight in order to win the bonus;

(m) providing a game rule 9) that Any Craps bet will lose on the two initial cards have a total pips of seven and eleven; Craps Blackjack bet will lose on the two initial cards have a total pips of two, three, and twelve; Any Craps bet will win on the two initial cards have a total pips of two and three, and push on twelve; Craps Blackjack bet will win on the two initial cards have a total pips of seven and eleven;

(n) game rule 10) allowing player who lost the wager on Any Craps bet or Craps Blackjack bet to have an option of playing the hand with additional wager, same amount as the original wager on Any craps or Craps Blackjack, place on Craps Blackjack bet or fold the hand;

(o) assigning a total number of two initial cards dealt to player to be the winning number and losing number as following: Any 7, said 3-4, 2-5, ace-6 and Any 11, said 2-9, 3-8, 4-7, 5-6, are the winning number of Craps Blackjack bet and losing number of Any Craps bet; Any 12, said 3-9, 4-8, 5-7, 6-6, are the pushing number of Any Craps bet and ace-deuce and ace-ace are the winning number of Any Craps bet, and Any 12, said 3-9, 4-8, 5-7, 6-6, ace-deuce and ace-ace are losing number of Craps Blackjack bet.

2. The method of claim 1, wherein six or eight decks of standard cards can be use in Craps Blackjack card game; picture cards such as, Jacks, Queens and Kings, each have a point card value of 10 points while Aces have a point card value of either 1 point or 11 points; the other cards namely 2s, 3s, 4s, 5s, 6s, 7s, 8s, 9s and 10s have a point card value equivalent to their face card value which are respectively 2, 3, 4, 5, 6, 7, 8, 9, and 10.

3. The method of claim 1, wherein each of the Craps Blackjack players individually playing against to the dealer; after players receive of the two initial cards, each player has the option of standing, draw additional cards, surrender, or fold the hand after the wagers on Any craps bet and Craps Blackjack bet have been resolved;

standing the hand is of not receiving any other cards;

draw is to draw one or more other cards from the dealer and to continue drawing cards until the player is either satisfied with their card count score and stops drawing cards (stands) or the player has busted, gone over the 21 point total;

surrender is withdraw the hand with losing half of the bet;

fold is player give out the hand after lost or win the wager on Any Craps bet or Craps Blackjack bet and dealer will lock the two initial cards;

players individually playing against to the dealer who wager on Any Craps bet only before the two initial cards are dealt to them and dealer has the option of continue playing the hand with additional wager place on Craps Blackjack or fold the hand after the wager on Any Craps is paid or lost;

players individually playing against to the dealer who wager on Craps Blackjack bet only before the two initial cards are dealt to them and dealer has the option of continue playing the hand with additional wager place on Craps Blackjack bet or fold the hand after the wager on Craps Blackjack bet is paid or lost;

the dealer has to draw additional cards or stand according to the rules after all the players played their hands.

4. The method of claim 1, wherein Any Craps is a primary bet that is betting on the outcome of two initial cards having total pip numbers of 2, 3, and 12, and playing the hand with conventional blackjack playing method with strategy of Craps Blackjack card game; Craps Blackjack is a secondary bet that is betting on the outcome of two initial cards having total pip numbers of 7 and 11, and for player playing the hand with conventional blackjack playing method with strategy of Craps Blackjack after the wager on Any Craps is resolved, win or lose; the first object of Craps Blackjack card game is to win the bonus of side bet on the two initial cards of total 2, 3, 7, 11 and 12 and two initial cards of player combine with dealer's face up card to form a three card straight; the second object of Craps Blackjack card game is to draw a hand having a value (a card sum or card point total) as close to 21 as possible without going over 21 and get a blackjack hand, which is the two initial cards contain an ace and a face card or a ten; wagers on the Any Craps betting spot will win the bonus when the two initial cards total points is 2, 3, and pushes on 12 and lose when the two initial cards total point is 7 and 11; wagers on Craps Blackjack betting spot will win when the two initial cards total point is 7 and 11 and lose when the two initial cards total point is 2, 3, and 12; player has to be interesting betting either Any Craps or Craps Blackjack in order to play side bets.

5. The method of claim 1, wherein dealer who deals cards to players every hand does not participate in making a wager; dealer starts dealing two initial cards from left to right clockwise from a card shoe to the players and himself one at a time after players placed initial wager on Any Craps or Craps Blackjack.

6. The method of claim 1, wherein the two initial cards contain an ace and any ten value card called Blackjack; when dealer got a blackjack hand the game is over; player who place wager on Any Craps and Craps Blackjack has a blackjack hand will have a push; the rest of hand is a lose; the wager on the Dragon's head and Phoenix's tail, ace-deuce, ace-ace, any eleven, any seven, and six-six side bets will get pay or lose according to the rules of bonus payout; the rest of hand is a lose; the wager on the Dragon's head and Phoenix's tail, ace-deuce, ace-ace, any eleven, any seven, and six-six side bets will get pay or lose according to the rules of bonus payout.

7. The method of claim 1, wherein players have the option to play Any Craps or Craps Blackjack only or both Any Craps and Craps Blackjack before the cards are dealt to the players and dealer; after seen the two initial cards, players who win or lose the wagers on Any Craps or Craps Blackjack have the option to continue playing the game if they place same amount of additional wager as the original wager on Any Craps or Craps Blackjack or fold the hand; players who wager on both Any Craps and Craps Blackjack before the two initial cards are dealt to the players and dealer have to play the hand based on conventional blackjack strategy casino offer; if the two initial cards dealt to player has a total of 4, 5, 6, 8, 9, 10, 13, 14, 15, 16, 17, 18, 19 or 20, player's wager on Any Craps and Craps Blackjack will not lose or win; player has to continue playing the blackjack game by using the strategy casino offer.

8. The method of claim 1, wherein the wager on primary bet, Any Craps, is betting on win from the outcome of two initial cards have any 12, 3 and 2; the wager on Craps Blackjack, secondary bet, is betting on win from the outcome of two initial cards have any 7 and any 11; the combination of 2 includes, ace-ace, the combination of 12 includes, 10-2, 9-3, 8-4, 7-5, and 6-6; the combination of 11 includes, 9-2, 8-3, 7-4, and 6-5; the combination of 3 includes, ace-2; the combination of 7 includes, ace-6, 3-4 and 5-2.

9. The method of claim 1, wherein player place the wager on the Any craps will be deal two initial cards face up; the wager will win even amount of money when the total pip number of two initial cards is 2, or 3, push on 12 and lose when the total pip number of two initial cards is 7 or 11; player place the wager on the Craps Blackjack will be deal two initial cards face up; the wager will win even amount of money when the total pip number of two initial cards is 7 or 11, and lose when the total pip number of two initial cards is 2, 3, or 12.

10. The method of claim 1, wherein player can place same amount of wager as the original wager placed on Any Craps before the two initial cards dealt to player on Craps Blackjack to continue play the blackjack game after dealer resolve the wager on the Any Craps, and using the same two initial cards to continue play the game or fold the hand; player can place same amount of wager as the original wager placed on Craps Blackjack before the two initial cards dealt to player on Craps Blackjack to continue play the blackjack game after dealer resolve the wager on the Craps Blackjack, and using the same two initial cards to continue play the game or fold the hand.

11. The method of claim 1, wherein when the player who wagers on Any Craps as initial bet only got a blackjack hand, the wager will get pay for blackjack and not allow to continue play the game with additional wager place on Craps Blackjack; wherein when the player who wagers on Craps Blackjack as initial bet only got a blackjack hand, the wager will get pay for blackjack and not allow to continue play the game with additional wager place on Craps Blackjack.

12. The method of claim 1, wherein the side bet, dragon's head and phoenix's tail (open ends straight) is one time bet that is betting on player's two initial cards combine dealer's face up card having a consecutive number, said, player's two initial cards are 2 and 3 combine dealer's face-up card, 4, to make a 2-3-4 combination; dealer's face card, 4, is called dragon's head; said, player's two initial cards are 2 and 3 combine dealer's face up card, ace, to make a 1-2-3 combination; dealer's face card, ace, is called phoenix's tail

| Dragon' Head Dealer's face up card | Player's two initial cards | Player's two initial cards | Phoenix's tail Dealer's face up card |
|---|---|---|---|
| Ace | King - Queen | Ace - King | Queen |
| King | Queen - Jack | King - Queen | Jack |
| Queen | Jack - Ten | Queen - Jack | Ten |
| Jack | Ten - Nine | Jack - Ten | Nine |
| Ten | Nine - Eight | Ten - Nine | Eight |
| Nine | Eight - Seven | Nine - Eight | Seven |
| Eight | Seven - Six | Eight - Seven | Six |
| Seven | Six - Five | Seven - Six | Five |
| Six | Five - Four | Six - Five | Four |
| Five | Four - Three | Five - Four | Three |
| Four | Three - Two | Four - Three | Two |
| Three | Two - Ace | Three - Two | Ace. |

13. The method of claim 1, the side bet Ace-Ace is betting on two initial cards contains two aces; the side bet Ace-Deuce is betting on two initial cards contains an ace and a deuce; the side bet Six-Six is betting on two initial cards contains two sixes; the side bet Any Seven is betting on two initial cards have a combination of 7, such as, ace-6, 2-5, 3-4; the side Any Eleven is betting on two initial cards have a combination of 11, such as, 9-2, 8-3, 7-4, 6-5.

14. The method of claim 1, wherein the electronic craps blackjack card game is using the same rules as a traditional blackjack card game rules, some of poker card game rule and some of craps dice game rules states on above.

15. The method of claim 1, wherein the traditional blackjack card game rules, stand, hit (take additional cards), surrender, splitting pairs, double down, buy insurance and bust are applying to the hands with total pip number of 2, 3, 4, 5, 6, 7, 8, 9, 10, 11, 12, 13, 14, 15, 16, 17, 18, 19, and 20.

* * * * *